US005728989A

United States Patent [19]

Utsumi et al.

[11] Patent Number: 5,728,989

[45] Date of Patent: Mar. 17, 1998

[54] INSULATION GAS FILLED CIRCUIT BREAKER

[75] Inventors: Tomoaki Utsumi; Fumihiro Endo; Takuya Sugawara; Goro Daimon; Kenji Tsuchiya, all of Hitachi, Japan

[73] Assignee: Hitachi, Ltd., Tokyo, Japan

[21] Appl. No.: 526,662

[22] Filed: Sep. 11, 1995

[30] Foreign Application Priority Data

Sep. 19, 1994 [JP] Japan ..... 6-222957

[51] Int. Cl.[6] ..... H01H 33/16

[52] U.S. Cl. ..... 218/145; 218/77

[58] Field of Search ..... 218/43, 46, 48, 218/57, 68, 74, 76, 77, 89, 143–147, 155, 156

[56] References Cited

U.S. PATENT DOCUMENTS

| | | | |
|---|---|---|---|
| 3,172,980 | 3/1965 | Thommen | 200/148 |
| 4,810,840 | 3/1989 | Okuno | 200/144 AP |
| 5,039,831 | 8/1991 | Sato et al. | 200/144 AP |
| 5,298,703 | 3/1994 | Yatsuzuka et al. | 200/144 |
| 5,451,731 | 9/1995 | Yoshizumi et al. | 218/143 |

FOREIGN PATENT DOCUMENTS 58-41949 9/1956 Japan .

*Primary Examiner*—Michael L. Gellner
*Assistant Examiner*—Michael A. Friedhofer
*Attorney, Agent, or Firm*—Fay, Sharpe, Beall, Fagan, Minnich & McKee

[57] ABSTRACT

An insulation gas filled circuit breaker in which a circuit breaking portion including two separably opposing contacts and a capacitor connected in parallel between the two contacts in the circuit breaking portion are disposed in a closed metal container filled with gas having an insulating property. A shield is provided at both the side of the capacitor facing the circuit breaking portion and the side of the capacitor facing the closed metal container for relaxing the electric field concentration near the capacitor. The top end of the shield is positioned so as to extend from the contacting face between the capacitor and an electrode pressing the capacitor toward the capacitor by a predetermined distance, whereby the dielectric strength of the capacitor connected in parallel with the circuit breaking portion is increased and a highly reliable and compact insulation gas filled circuit breaker of a high voltage and a large capacity use is provided.

15 Claims, 6 Drawing Sheets

INSULATION GAS FILLED CIRCUIT BREAKER

BACKGROUND OF THE INVENTION

1. Field of the Invention

The present invention relates to an insulation gas filled circuit breaker (hereinafter called a gas circuit breaker) and, in particular, to a structure of a gas circuit breaker in which an impedance element such as a capacitor is connected between electrodes in the circuit breaking portion thereof for suppressing a recovery voltage increase which is caused immediately after a current interruption.

2. Description of Related Art

A gas circuit breaker includes a circuit breaking portion consisting of a stationary contact and a movable contact accommodated in a metal container filled with insulation gas. Further, a capacitor for suppressing the recovery voltage is electrically connected in parallel between the stationary and movable contacts in the circuit breaking portion and is disposed in the separating direction of the movable contact. In a conventional gas circuit breaker of this type, for example as disposed in JP(U)-A-58-41949(1983), a shield for a circuit breaking portion is provided for reducing electric field intensity at the circuit breaking portion so as to reduce the electric field intensity, in particular, at the top ends of the two contacts, and the positional relationship between the circuit breaking portion and the capacitor is determined so as to further reduce the electric field intensity at the circuit breaking portion. Thereby the circuit breaking performance as well as the dielectric strength between the electrodes of the gas circuit breaker are improved.

At present, networking of an electric power transmission system has advanced and the need for an interruptable current required for a circuit breaker is increasing. Accordingly, the capacitance of the capacitor required for connection between the electrodes has increased. Further, in association with voltage level increases in the electric power transmission system the dielectric strength required for the capacitor also has increased.

In the above exemplified conventional gas circuit breaker, the dielectric strength of the capacitor was poor, because the electric field intensity near the capacitor was not taken into account. Therefore, in order to achieve a required dielectric strength. The number of serially connected capacitor elements was increased to prolong the insulation distance. As a result the entire size of the gas circuit breaker was enlarged. Further, through the increase of the serially connected capacitor elements, the resultant electrostatic capacitance thereof was decreased. Therefore in order to achieve a required electrostatic capacitance, the number of parallel connected capacitors was increased which also caused the size enlargement of the entire gas circuit breaker and the cost increase thereof.

SUMMARY OF THE INVENTION

An object of the present invention is to provide a high voltage and compact gas circuit breaker having a large capacity through an improvement of the dielectric strength of a capacitor connected thereto.

For achieving the above object, in a gas circuit breaker according to the present invention, a shield for relaxing the electric field concentration near the capacitor is respectively provided at both sides of the capacitor. At the side facing a metal container and at the side facing a circuit breaking portion thereof, the shield is disposed in such a manner that the top end of the shield extends from a contact face between the capacitor end and a pressing electrode for the capacitor by a predetermined distance toward the side of the capacitor, and the predetermined distance is selected from 0.5 to three times the distance from the side face of the capacitor to the top end of the shield.

According to the present invention, distortion of the electric field near the capacitor is reduced and the dielectric strength of the capacitor is increased. Thereby, the number of serially connected capacitor elements is reduced and as well, the electrostatic capacitance of the capacitor can be increased. Accordingly, the number of parallel connected capacitors is decreased and a low cost and compact gas circuit breaker is realized.

DESCRIPTION OF THE PREFERRED EMBODIMENTS

Hereinbelow, embodiments of the present invention are explained with reference to the drawings.

Figure 1:
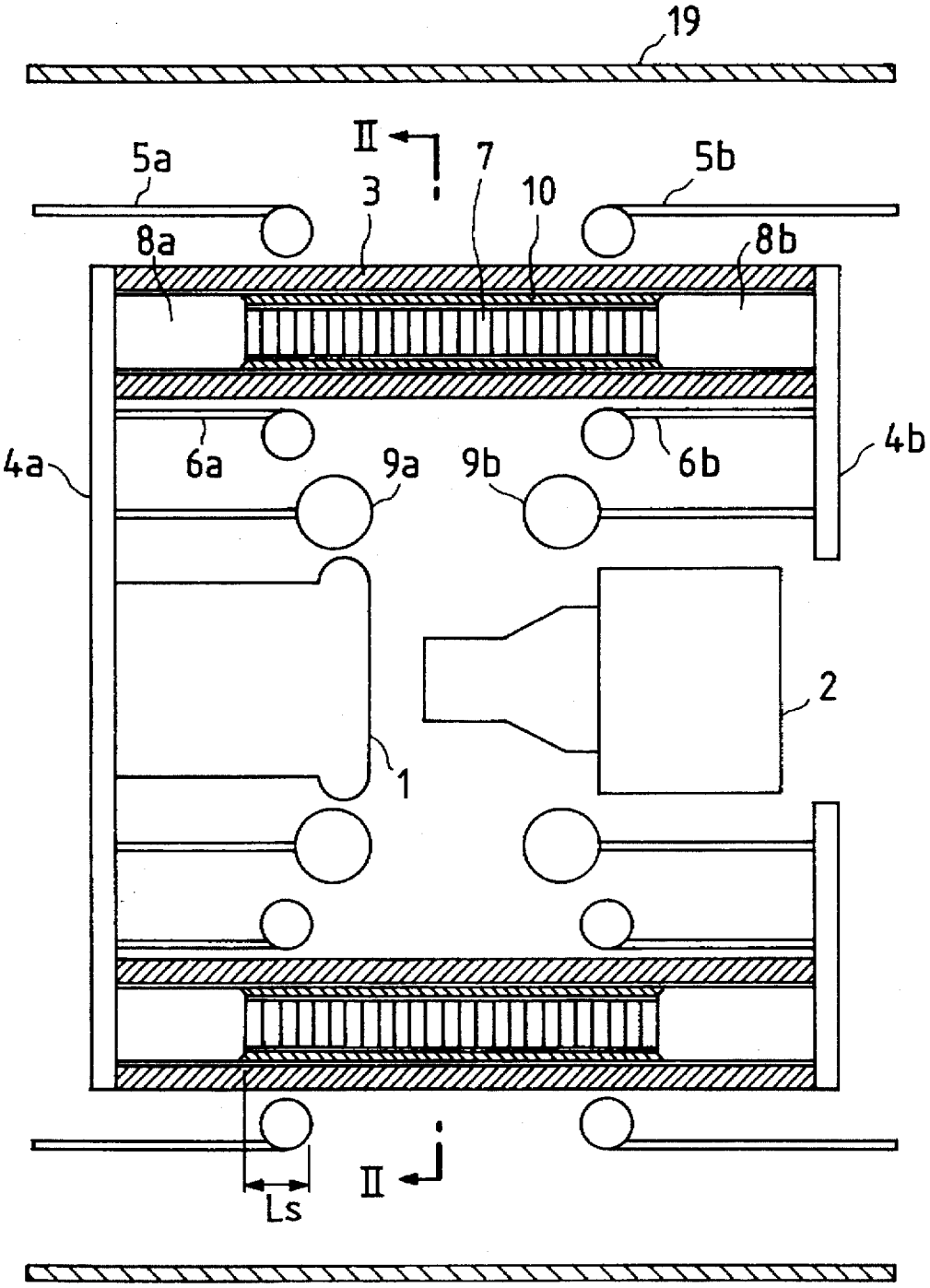
FIG. 1 is a schemetic vertical cross sectional view of a circuit breaking portion of a specific embodiment according to the present invention.

FIG. 1 is an embodiment of a gas circuit breaker according to the present invention.

A gas circuit breaker has a structure wherein a circuit breaking portion consisting of a stationary contact 1 and a movable contact 2 is disposed in a closed cylindrical metal container 19 substantially at the center thereof as shown in FIG. 1. In the metal container 19, SF6 gas having excellent arc extinguishing and electrical insulating properties is filled. The stationary contact 1 and the movables contact 2 are respectively secured to conductors 4*a* and 4*b* and electrically connected .thereto, and the conductors 4*a* and 4*b* are fixedly connected by an inter-electrode insulator supporting member 3. The movable contact 2 is designed to receive an activating force therefor from the outside of the metal container 19 via an insulated operation rod not shown, and performs a making and breaking operation. The inter-electrode insulator supporting member 3 is provided with a plurality of cylindrical holes into which respective inter-electrode capacitors 7 each constituted by a plurality of capacitor elements are accommodated and the respective interelectrode capacitors 7 are connected in parallel with the circuit breaking portion via respective capacitor pressing electrodes 8*a* and 8*b* contacting the ends of the respective capacitors 7.

Figure 2:
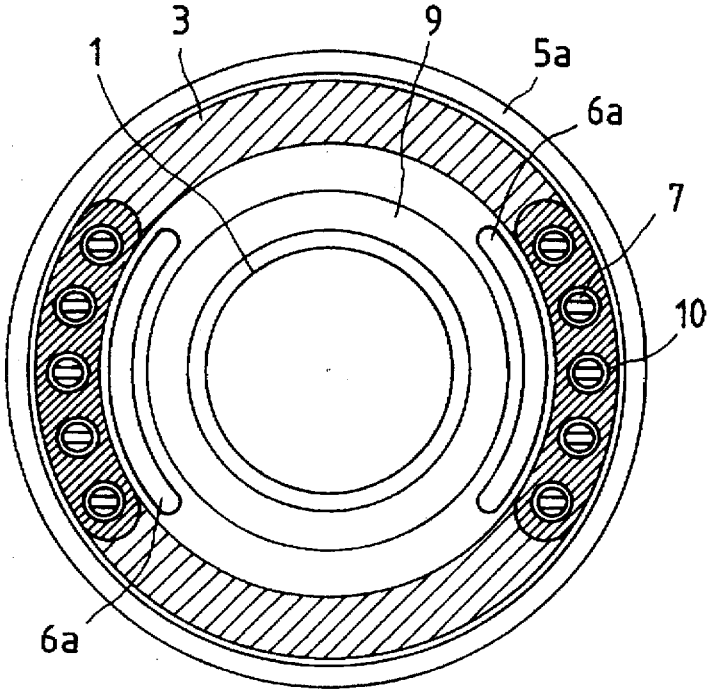
FIG. 2 is a cross sectional view seen from II—II in FIG. 1.

FIG. 2 is a cross sectional view seen from line II—II of the gas circuit breaker as shown in FIG. 1, wherein the number of parallel capacitors 7 is selected to be 10.

According to the present embodiment of the gas circuit breaker having the above explained components, outer shields 5*a* and 5*b* and inner shields 6*a* and 6*b* are provided for relaxing electrical field concentration near the capacitors 7. With these measures the dielectric strength of the capacitors 7 is improved, the number of serially connected capacitor elements in respective capacitors 7 is reduced as well the number of parallel capacitors 7 so that the size of the gas circuit breaker is also reduced. Further, with the provision of shields 9*a* and 9*b* for the circuit breaking portion separate from the shields 5*a*, 5*b*, 6*a* and 6*b*, the electric field intensity near the stationary contact 1 and the movable contact 2 is reduced and the interelectrode dielectric strength after circuit interruption, namely after completing separation of the movable contact 2 from the stationary contact 1, is improved. Thereby, because of the shortening of the inter-electrode distance, the size of the circuit breaking portion is reduced as well. Because of the shortening of the stroke of the movable contact 2, the size of the operating mechanism therefor is also reduced.

Hereinbelow, the principle of how the dielectric strength is improved in the gas circuit breaker according to the present embodiment as indicated above is explained in greater detail.

Figure 3:
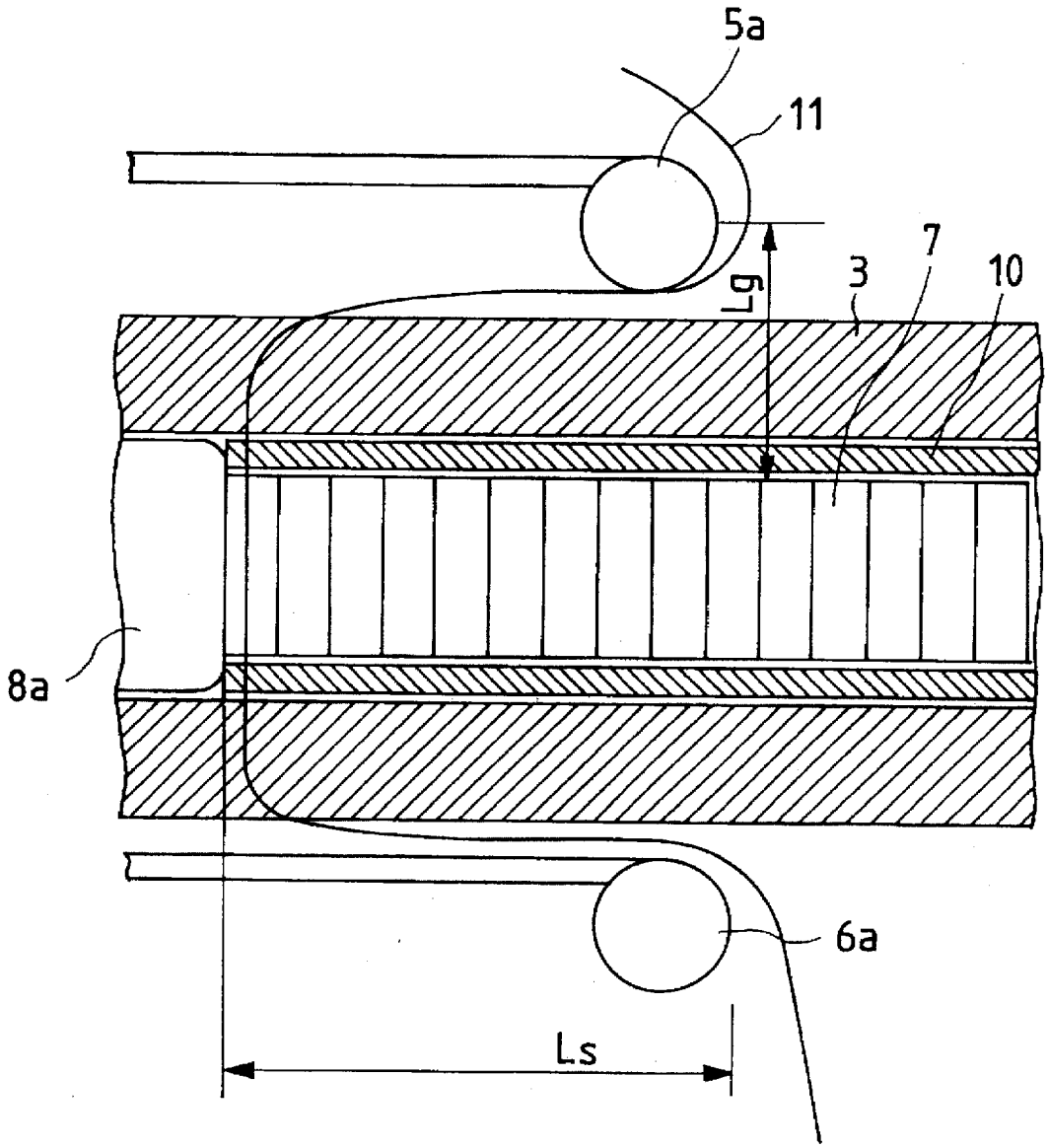
FIG. 3 is an enlarged cross sectional view of a capacitor connected between the electrodes in FIG. 1.

FIG. 3 is an enlarged cross sectional view of a portion of the capacitor 7. The shields 5*a* and 6*a* for the capacitor 7 are arranged so as to extend toward the side of the capacitor 7 beyond capacitor pressing electrode 8*a* and the distance Ls between the top or inner ends of the shields 5*a* and 6*a* and the capacitor pressing electrode 8*a* is selected to be about twice as long as the distance Lg between the top or inner ends of the shields 5*a* and 6*a* and the side face of the capacitor 7. Thereby, the electric field distortion near the capacitor 7 is reduced and the dielectric strength of the capacitor 7 is improved.

Figure 4:
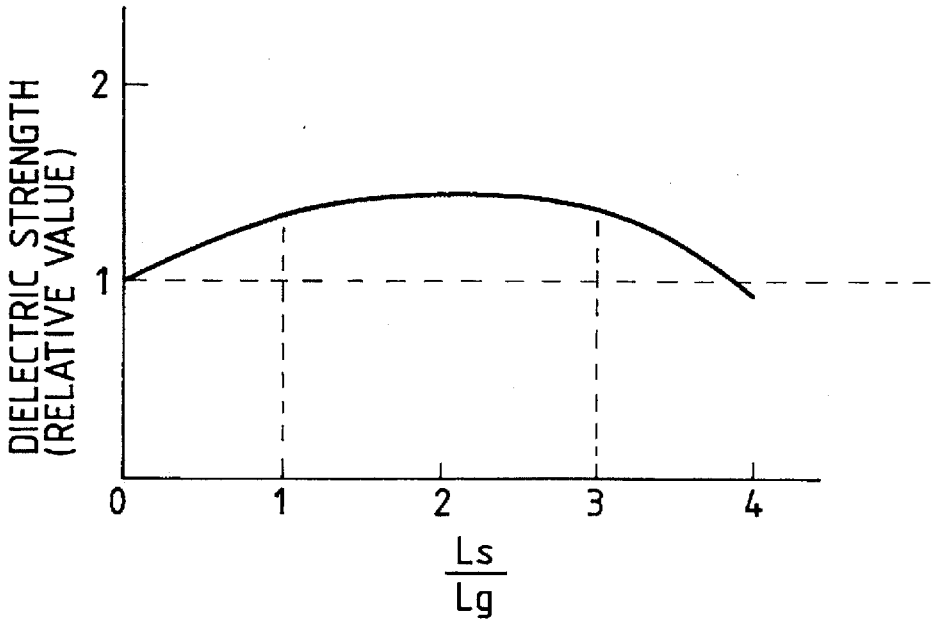
FIG. 4 is a characteristic diagram showing a relationship between a ratio of distance from the top end of a shield for a capacitor to the end of the capacitor and to the side of the capacitor and the dielectric strength of the capacitor.

FIG. 4 is a graph showing exemplary relationships between the ratio of Ls/Lg and the dielectric strength of the capacitor 7. The graph shows that when the ratio of Ls/Lg is about 2 the dielectric strength is maximized, in that the dielectric strength at that ratio is about 1.5 times of those when Ls=0. Further, in the range from 1 to 3 of the ratio of Ls/Lg, the dielectric strength reduces merely about less than 3% of those when the ratio of Ls/Lg is 2. However, when the ratio of Ls/Lg deviates from the above indicated range, the dielectric strength reduces to an unacceptable level.

The reason why the dielectric strength near the capacitor 7 is increased by the proper selection of the distance Ls is that the electric field distortion near the capacitor 7 is reduced thereby.

Figure 5:
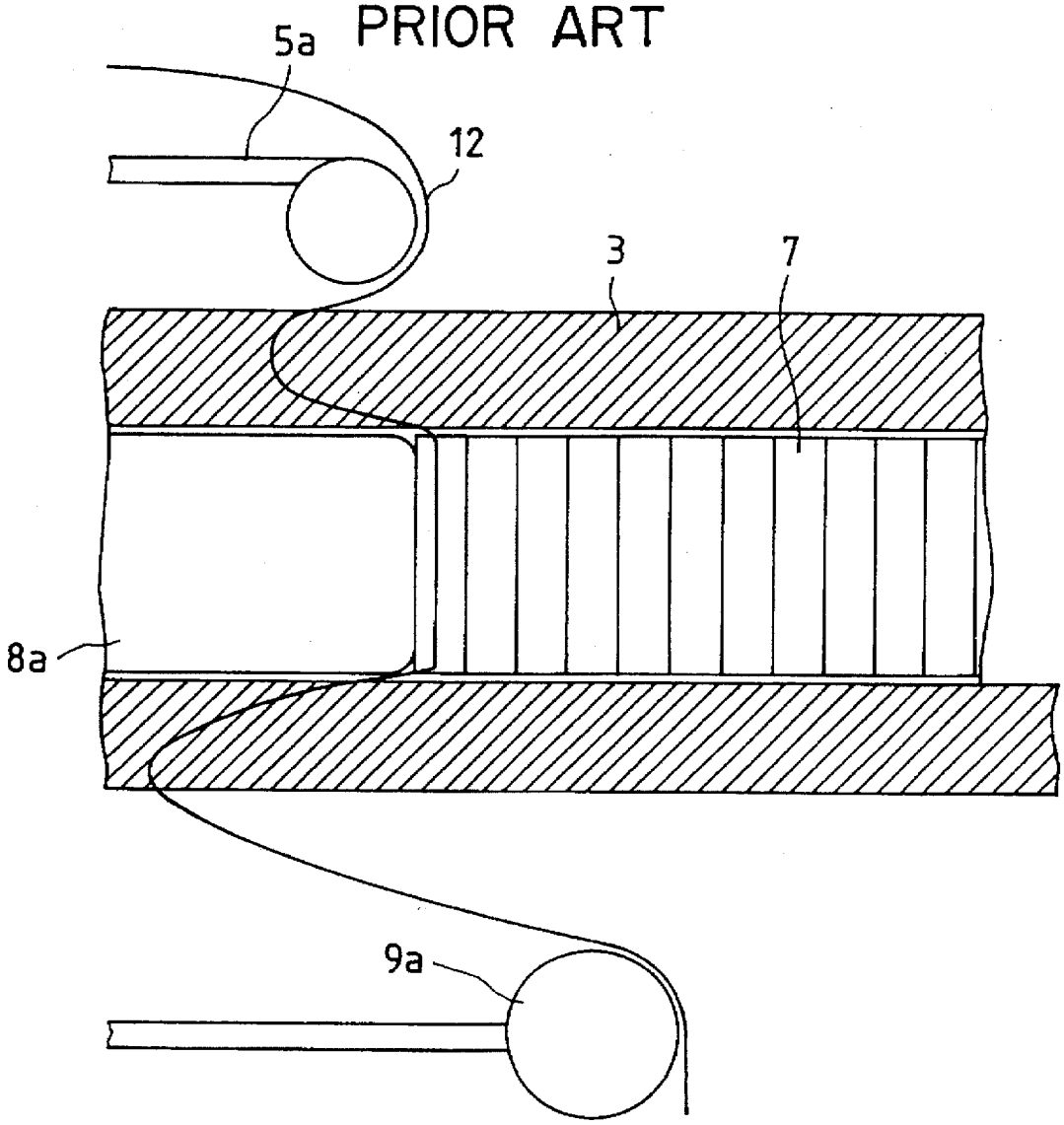
FIG. 5 PRIOR ART
FIG. 5 is an electric field distribution at a capacitor portion connected between electrodes in a conventional gas circuit breaker.

FIG. 5 shows a structure near a capacitor pressing electrode 8*a* in an example of conventional gas circuit breakers. The position of the top end of the shield 5*a* with respect to the capacitor 7 is selected substantially the same as that of the top end of the capacitor pressing electrode 8*a*. In this instance an equipotential line 12 creeps in between the shield 5*a* and the capacitor pressing electrode 8*a* and increases an electric field distortion at the corner of the capacitor pressing electrode 8*a* which causes reduction of dielectric strength of the capacitor 7. Further, although the shield 9*a* for the circuit breaking portion is provided, no shield 6*a* is provided near the inner side of the capacitor 7 and the electric field distortion at the corner of the capacitor pressing electrode 8*a* is further increased.

Contrary thereto, in the present embodiment an equipotential line 11 intersects perpendicularly with the side face of the capacitor 7 as shown in FIG. 3. Thereby, the electric field distortion at the top end of the capacitor pressing electrode 8*a* is reduced and the dielectric strength of the capacitor 7 is improved. However, if the distance Ls is excessively increased, the resultant electric field is distorted in the opposite direction as in FIG. 5, and the dielectric strength to the contrary reduces as will be understood from FIG. 4.

The above explained fact is applicable to a case wherein, instead of inserting the capacitors 7 into the inter-electrode supporting insulator member 3, the respective capacitors 7 are inserted into corresponding separate insulator cylinders and are arranged in parallel between the electrodes in the circuit breaking portion. Normally, the thickness of the these insulator cylinders is thinner than that of the inter-electrode supporting insulator member 3 which contributes to reduce the distance Lg. Accordingly, proportional thereto, a proper distance of Ls is likely shortened while maintaining the above explained relationship with regard to the ratio of Ls/Lg. Further, the above explained fact is also applicable when impedance elements other than the capacitors are disposed within the gas circuit breaker.

In the embodiment as shown in FIGS. 1 through 3, before inserting the capacitor 7 into the inter-electrode supporting insulator member 3, the capacitor 7 is at first inserted into an insulator cylinder 10 having a lower dielectric constant than that of the interelectrode supporting insulator member 3. With this measure, and the electric field intensity at the side face of the capacitor 7 is reduced and the dielectric strength of the capacitor 7 is improved.

Figure 6:
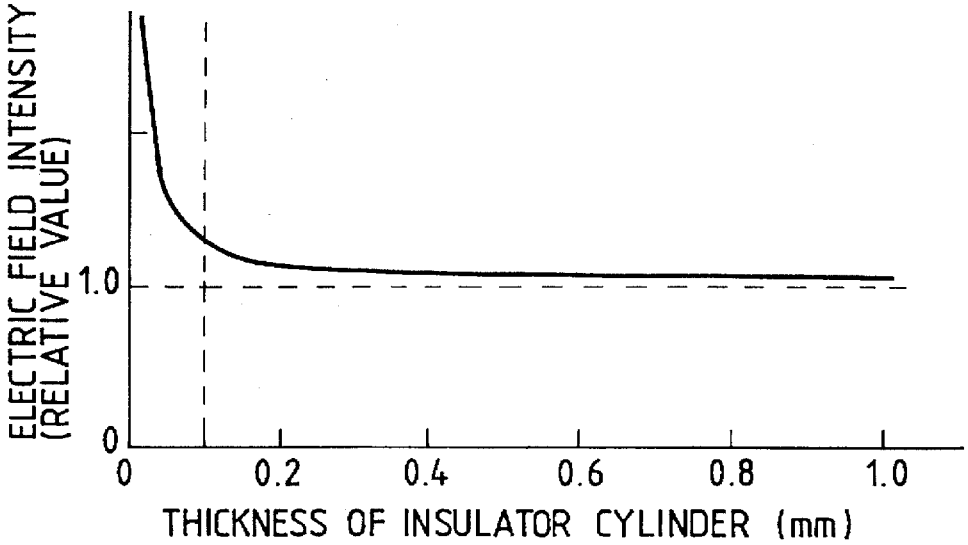
FIG. 6 is a charactristic diagram showing a relationship between thickness of an insulator cylinder having a low dielectric constant and accommodating capacitor elements therein and electric field intensity thereabout.

FIG. 6 shows a relationship between electric field intensity at an electric field concentrating portion of the capacitor 7 and the thickness of the insulator cylinder 10. In FIG. 6, the electric field is represented by a relative value with respect to an electric field value when the thickness of the insulator cylinder 10 is sufficiently thick, the thicker is the thickness of the insulator cylinder 10, the more relaxed is the electric field concentration, and when the thickness of the insulator cylinder 10 is selected to be more than 0.1 mm, the electric field concentration is sufficiently relaxed. Accordingly, with the thickness of the insulator cylinder 10 of more than 0.1 mm the dielectric strength of the capacitor 7 is increased.

However, if the thickness of the insulator cylinder 10 is increased more than 10 mm, the electric field concentration reduction effect does not further increase and further the diameter of the holes to be formed in the inter-electrode supporting insulator member 3 for accommodating the respective capacitors 7 excessively increses which reduces the mechanical strength of the inter-electrode supporting insulator member 3. Therefore the thickness of the insulator cylinder 10 is selected to be less than 10 mm.

The inter-electrode supporting insulator member 3 is mostly injection-molded by such as alumina filled epoxy resin having a dielectric constant of 5~8. Accordingly, as dielectric materials having a lower dielectric constant for the insulator cylinder 10, fluorocarbon resin materials such as polymers of ethylene tetrafluoride including ones having a dielectric constant less than 2.5 can be used.

In the FIG. 3 embodiment, the diameter of the capacitor pressing electrodes 8*a* and 8*b* is larger than the inner diameter of the insulator cylinder 10. With this measure when inserting the capacitors 7 into the inter-electrode supporting insulator member 3, the insulator cylinder 10 can be pressed in by the capacitor pressing electrodes 8*a* and 8*b*. Thereby and the insulator cylinder 10 is reliably arranged along the side face of the capacitor 7. In this instance, the length of the insulator cylinder 10 is selected less than that of the capacitor 7.

Further, when the diameter of the capacitor pressing electrodes 8*a* and 8*b* is smaller than the outer diameter of the insulator cylinder 10, the diameter of the holes to be formed in the inter-electrode supporting insulator member 3 for receiving the capacitors 7 can be determined substantially the same as the outer diameter of the insulator cylinder 10. Thereby the displacement of the capacitors 10 in the holes is suppressed and mechanical damage thereof is prevented which improves the reliability of the capacitors 7 inserted therein.

With the above explained measures, the dielectric strength of the capacitors 7 can be increased. Thereby the number of serially connected capacitor elements which constitute respective capacitors 7 can be reduced and the length of the respective capacitors 7 may be shortened. Further, with the reduction of serially connected capacitor elements, the resultant capacitance of the respective capacitors 7 is increased, whereby a required electrostatic capacitance for a gas circuit breaker can be easily obtained and a down sizing and reliability of a high voltage and large capacity gas circuit breaker is achieved. Still further, with the shortening of the capacitor length, the length of the inter-electrode supporting insulator member 3 is also shortened whereby the mechanical strength and reliability of the inter-electrode supporting insulator member 3 are improved and the production cost thereof is also reduced.

When the dielectric strength of the capacitors 7 is maintained with the thus constituted shields 5*a*, 5*b*, 6*a* and 6*b* for the capacitor use, the shields 9*a* and 9*b* for the circuit breaking portion do not have any influence on the dielectric strength of the capacitors 7. Accordingly, the shields 9*a* and 9*b* for the circuit breaking portion can be designed with regard to their location and configuration primarily for the purpose of reducing electric field intensity at the circuit breaking portion.

Figure 7:
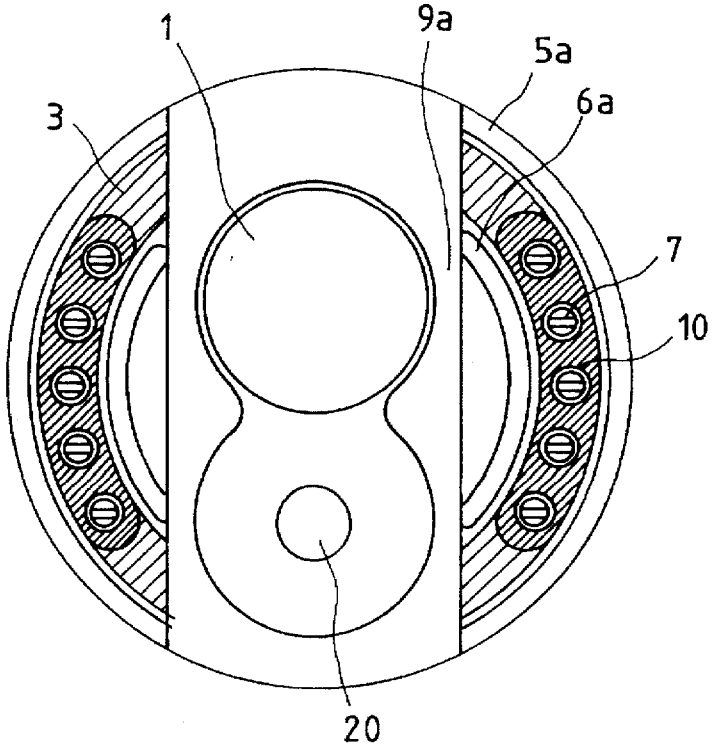
FIG. 7 is a cross sectional view of another embodiment according to the present invention which is applied to a gas circuit breaker with resistance make contacts.
Figure 8:
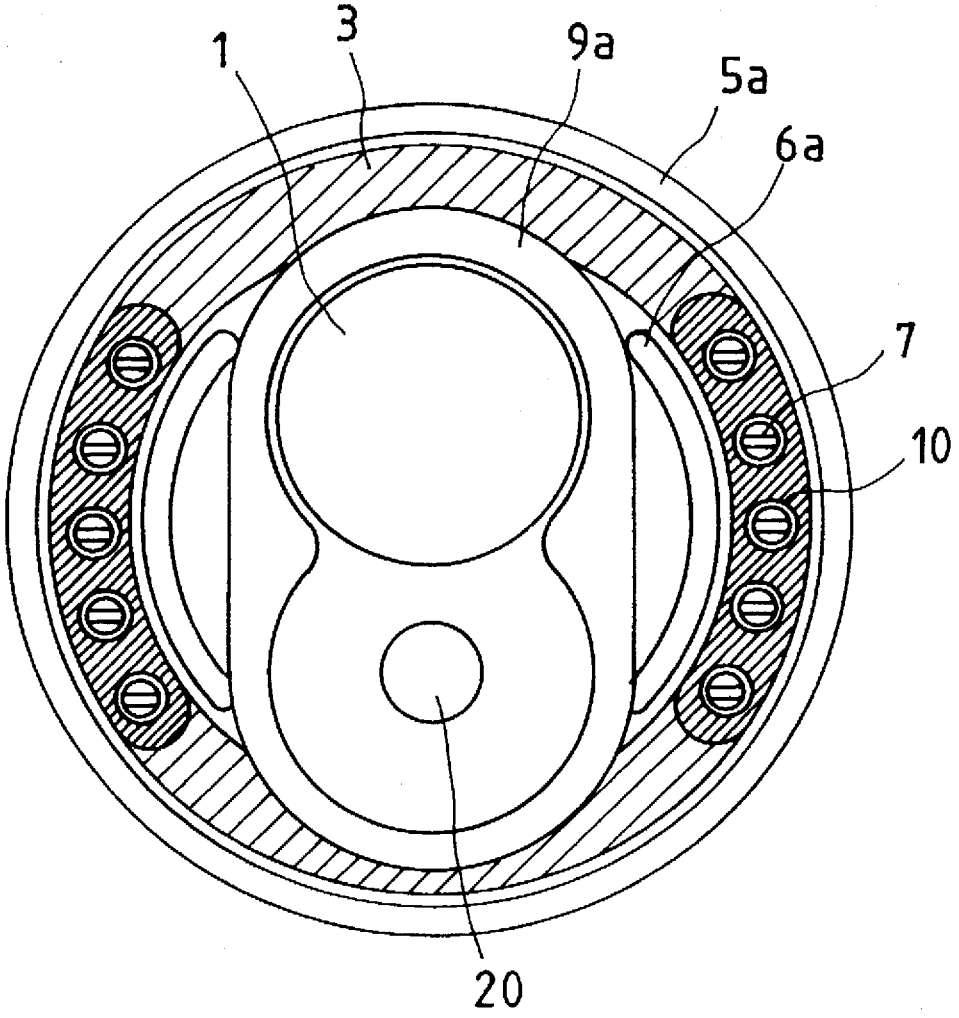
FIG. 8 is a cross sectional view of still another embodiment according to the present invention which is applied to a gas circuit breaker with resistance make contacts.

FIGS. 7 and 8 are cross sectional views of other embodiments according to the present invention in which the present invention is applied to a gas circuit breaker including make resistance contacts 20. FIG. 7 is an embodiment in which the shield 9*a* for the circuit breaking portion is connected to the outer shield 5*a* for the capacitor 7. FIG. 8 is another embodiment in which the shield 9*a* for the circuit breaking portion is provided independent from the outer shield 5*a* for the capacitor 7. The shield 9*a* for the circuit breaking portion as shown in FIG. 8 can be, for example, easily produced by combining two metal pipes.

With these constitutions, the electric field intensity at the stationary contact 1 and the movable contact 2 is reduced and the dielectric strength between electrodes in the circuit breaking portion is increased, whereby the inter-electrode dielectric strength after the current interruption is improved. As a result, with the shortening of the inter-electrode distance, the size of the circuit breaking portion is reduced as well as with the shortening of the stroke of the movable contact 2. The size of the operating mechanism therefor is reduced.

With the above constitution, when effecting the coordination of insulation by maintaining the dielectric strength of the capacitors 7 and that between the electrodes in the circuit breaking portion at a same level, the capacitors 7 assume a length in a range from more than 2 and less than 3 times of the distance between the electrodes in the circuit breaking portion.

According to the present invention as explained above, the amount of capacitors can be reduced which are connected in parallel with the circuit breaking unit while maintaining a desired dielectric strength for a gas circuit breaker. Further the size of the circuit breaking portion can be also reduced. Whereby a highly reliable and compact gas circuit breaker for a high voltage and a large capacity use is realized.

We claim:

1. An insulation gas filled circuit breaker comprising: a closed metal container filled with gas having insulating property; a circuit breaking portion including separably opposing first and second contacts disposed in said closed metal container; an impedance means connected in parallel with said circuit breaking portion and disposed between an inner wall of said closed metal container and said circuit breaking portion; and an inner shield provided near said impedance means between said circuit breaking portion and said impedance and an outer shield provided near said impedance means between said inner wall of said closed metal container and said impedance means for relaxing electric field concentration at said impedance means, and wherein each inner end of said inner and outer shields is positioned so as to extend from a contacting face between said impedance means and an electrode for said impedance means by a predetermined distance, said predetermined distance being determined in a range from 0.5 to 3 times a distance from said inner ends of said inner and outer shields to said impedance means.

2. An insulation gas filled circuit breaker according to claim 1, further comprising a further shield provided around said circuit breaking portion for decreasing electric field intensity at said circuit breaking portion.

3. An insulation gas filled circuit breaker comprising: a closed metal container filled with gas having insulating property; a circuit breaking portion including separably opposing first and second contacts disposed in said closed metal container; a capacitor connected in parallel between said first and second contacts and disposed between an inner wall of said closed metal container and said circuit breaking portion and an inner shield provided near said capacitor between said circuit breaking portion and said capacitor and an outer shield provided near said capacitor between said inner wall of said closed metal container and said impedance means for relaxing electric field concentration at said capacitor, and wherein each inner end of said inner and outer shields is positioned so as to extend from a contacting face between said capacitor and an electrode for said capacitor by a predetermined distance, said predetermined distance being determined in a range from 0.5 to 3 times a distance from said inner ends of said inner and outer shields to said capacitor.

4. An insulation gas filled circuit breaker according to claim 3, further comprising an inter-electrode supporting insulator member supporting said first and second contacts, and wherein said capacitor is accommodated in said inter-electrode supporting insulator member and said inner shield is disposed between said interelectrode supporting insulator member and said circuit breaking portion and said outer shield is disposed between said inter-electrode supporting insulator member and the inner wall of said closed metal container.

5. An insulation gas filled circuit breaker according to claim 4, wherein said capacitor is disposed in said inter-electrode supporting insulator member under a condition that said capacitor is first accommodated in an insulator cylinder having a smaller dielectric constant than that of said inter-electrode supporting insulator member.

6. An insulation gas filled circuit breaker according to claim 5, wherein said insulator cylinder having a smaller dielectric constant is comprised of a fluorocarbon resin.

7. An insulation gas filled circuit breaker according to claim 6, wherein a thickness of said insulator cylinder having a smaller dielectric constant is determined in a range from 0.1 mm to 1.0 mm.

8. An insulation gas filled circuit breaker according to claim 6, wherein a diameter of said electrode for said capacitor is selected larger than an inner diameter of said insulator cylinder having a smaller dielectric constant.

9. An insulation gas filled circuit breaker according to claim 5, wherein a thickness of said insulator cylinder having a smaller dielectric constant is determined in a range from 0.1 mm to 1.0 mm.

10. An insulation gas filled circuit breaker according to claim 9, wherein a diameter of said electrode for said capacitor is selected larger than an inner diameter of said insulator cylinder having a smaller dielectric constant.

11. An insulation gas filled circuit breaker according to claim 5, wherein a diameter of said electrode for said capacitor is selected larger than an inner diameter of said insulator cylinder having a smaller dielectric constant.

12. An insulation gas filled circuit breaker according to claim 11, wherein the diameter of said electrode for said capacitor is selected smaller than an outer diameter of said insulator cylinder having a smaller dielectric constant.

13. An insulation gas filled circuit breaker according to claim 3, wherein a diameter of said electrode for said capacitor is selected larger than a diameter of said capacitor.

14. An insulation gas filled circuit breaker according to claim 3, wherein a length of said capacitor is determined in a range from 2 to 3 times a distance between said first and second contacts when said first and second contacts in said circuit breaking portion are separated the most.

15. An insulation gas filled circuit breaker according to claim 3, further comprising a further shield provided around said circuit breaking portion for decreasing electric field intensity at said circuit breaking portion.

* * * * *